US007500441B2

(12) United States Patent
Van-Zwol

(10) Patent No.: US 7,500,441 B2
(45) Date of Patent: Mar. 10, 2009

(54) REMOTE WATERLINE CLEANER

(76) Inventor: Feitze Van-Zwol, 2631 Arbor Dr., Fort Lauderdale, FL (US) 33312

( * ) Notice: Subject to any disclaimer, the term of this patent is extended or adjusted under 35 U.S.C. 154(b) by 197 days.

(21) Appl. No.: 11/443,603

(22) Filed: May 31, 2006

(65) Prior Publication Data

US 2008/0011216 A1 Jan. 17, 2008

(51) Int. Cl.
*B63B 59/00* (2006.01)

(52) U.S. Cl. ..... 114/222

(58) Field of Classification Search ..... 114/312, 114/222

See application file for complete search history.

(56) References Cited

U.S. PATENT DOCUMENTS

| | | | | |
|---|---|---|---|---|
| 560,646 | A | 5/1896 | Reilly | |
| 826,012 | A | 7/1906 | Beelendorf | |
| 4,153,000 | A * | 5/1979 | Henderson | 114/222 |
| 4,324,678 | A | 4/1982 | Howson | |
| 4,412,932 | A | 11/1983 | Howson | |
| 4,838,193 | A | 6/1989 | Van der Tak | |
| 5,174,222 | A | 12/1992 | Rogers | |
| 5,730,553 | A * | 3/1998 | Miura et al. | 405/190 |
| 6,263,821 | B1 | 7/2001 | Hodder | |
| 7,279,051 | B2 * | 10/2007 | Griffith | 134/6 |
| 2004/0074431 | A1 * | 4/2004 | Tible | 114/222 |

* cited by examiner

*Primary Examiner*—Stephen Avila

(57) ABSTRACT

An apparatus for cleaning dirty waterlines on yachts, being robotic and self powered, capable of floating on its own, employing a rotating soft scrub brush, able to propel itself to the dirty waterline and once in contact supply sufficient force for cleaning, able to apply soap and water, contains various electronics for remote operation, is remote controlled and capable of being fully automatic with the use of a microcontroller, operated and carried by one person. The materials of the cleaner are corrosion resistant so that it can endure the corrosion-infested environments it will be in. The cleaner also has means of adjusting the cleaning brush so it can reach all areas of the waterline with ease.

3 Claims, 3 Drawing Sheets

REMOTE WATERLINE CLEANER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention generally relates to boats and/or yachts, specifically to a device for assisting in cleaning dirty waterlines on boats.

2. Prior Art

The main reason such a product is necessary is that current methods for cleaning waterlines on yachts take nearly a day to complete. The waterlines on yachts are likely to always be dirty. Because of the constant changing environment yachts are in, the waterline is always subject to oil, fuel, and mud turned up in the harbors. As well, the environment boats are in is unstable, including but not limited to; waves, currents, winds, etc. causing the waterlines to be in need of constant attention. A waterline can be recently cleaned and a few moments later a boat comes in and turns up the bottom mud and waves wash the mud onto your freshly cleaned waterline that is now dirty. Dirty enough that spraying the hose will not remove the dirt from the waterline. A waterline might be cleaned once a week depending on the crew. With my product, the waterline can be cleaned efficiently and effectively everyday in a reduced amount of time. There are approximately four main methods of cleaning:

a) Launch a small boat or dinghy into the water. Have one human operate the dinghy while another human operates the scrub brush. The disadvantages here are; Two people are needed to perform the task of cleaning the waterline. There is risk of bumping into the yacht because both boats will be within close proximity of about 8 ft. or less. The dinghy needs to be taken out of the water, flushed clean with freshwater, washed, and stored away properly; which might include hoisting it back onto the yacht and properly securing it. The method is time consuming and takes at minimum two people.

b) Use a telescoping pole. This method only works for boats up to approximately 50 ft in length. The telescoping pole brushes extend approximately 15 to 20 ft. This much length causes a great lever arm effect to the user and causes much back strain. The user can clean from the dock or on the boat itself. If on the boat, the user must bend over the railing and risk falling into the water, as well as, work twice as hard to clean the waterline because of the mechanical disadvantage created by the extended length. Furthermore, the shape of the bows on most larger boats in excess of 50 ft. allow for no access to the waterline from above.

c) Use a floating dock. This method takes three people for it to be anywhere near efficient. Two people must hold the floating dock at all times while the third person scrubs the waterline. If only one person were to hold the floating dock, a torque steer would be created when scrubbing is applied. It is a lot easier to apply a push force than it is to hold onto a boat hull with no positive gripping places. Therefore, two people are needed to hold on. Many times, there is no place to grab onto and two people need to paddle while the third person scrubs.

d) Go into the water. This method is more efficient than methods 1, 2, and 3 yet is favored the least. Going into the water puts the human at risk. Some harbors are polluted and no one wants to go into the water. Some boats discharge raw sewage into water, not allowed, but it happens; hopefully the person cleaning the waterline is not in the water at this time. Boats are constantly coming into the docks and this puts the person in the water at danger. A person must always be on watch looking out for incoming boats and signaling them that there is a person in the water. Furthermore, the side of the boat facing the dock is extremely dangerous for a person to clean because they risk being crushed in-between the dock and boat.

All these methods work, yet are time consuming, require two or more people, and are mentally and physically stressful to the user who has to scrub. A great improvement can be made to cleaning waterlines and all boaters can benefit.

3. Objects and Advantages

Accordingly, besides the objects and advantages of the remote waterline cleaner described in my above patent, several objects and advantages of my invention are:

(a) to provide a remote waterline cleaner which can be used by one person and eliminate the possibility of a small boat damaging the yachts hull from banging into it because of the unstable environment;

(b) to provide a remote waterline cleaner which takes the physical work itself and has the capability of maneuvering to problem areas which can not be reached by a telescoping brush.

(c) to provide a remote waterline cleaner which eliminates the need of using a floating dock to get to areas otherwise not accessible from the boat or dock and reduce the amount of manpower needed.

(d) to provide a remote waterline cleaner which allows the user to operate from the boat or dock and not go into a hazardous environment.

Further objects and advantages are to provide a remote waterline cleaner which can be used easily and conveniently to remove the scum off boat waterlines, which is constructed of corrosion resistant materials, which provides sufficient force for cleaning those heavy areas where the scum has built up, which applies soap and water for cleaning, which has an onboard camera for areas where visibility is impaired, which has a microcontroller for a fully automatic operation, which has sensors to provide signals to the microcontroller, which has dimensions small enough to fit through entrance doors and would inherently be small and light enough to be carried by an average man, and which is remote controlled. Still further objects and advantages will become apparent from a consideration of the ensuing description and drawings.

SUMMARY

In accordance with the present invention a remote waterline cleaner comprises of brushes, applies soap and water, is corrosion resistant, is compact, has the ability of remote controlled or fully autonomous operation, has a video camera for live feedback, and is durable enough to defend against the elements of fresh and saltwater environments.

DRAWING—FIGURES

DRAWINGS—REFERENCE NUMERALS

Figure 1:
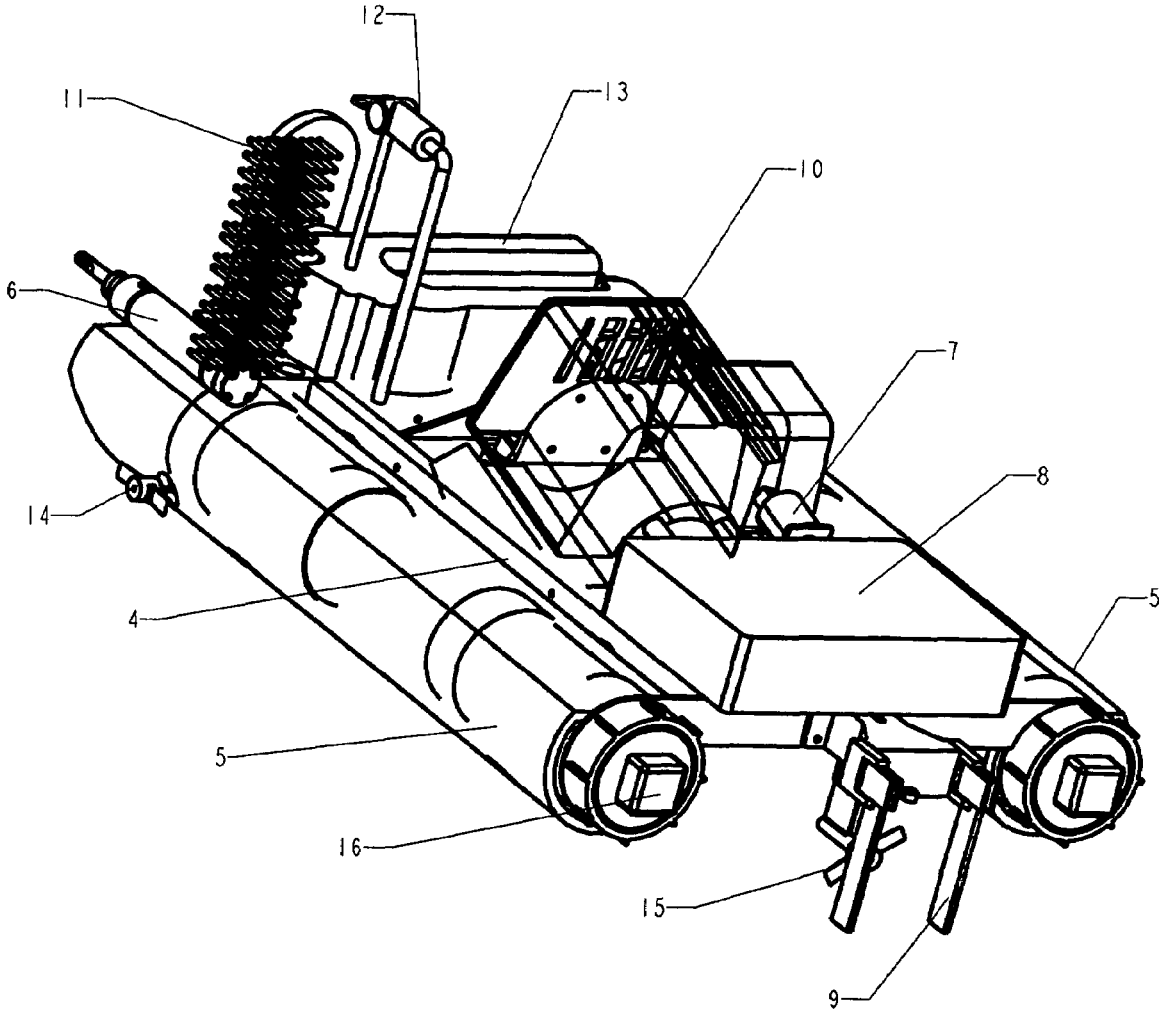
FIG. 1 is a perspective view of my invention with drawing reference numerals.

4. aluminum main frame
5. pontoon hull
6. pressure sensor
7. generator
8. electronics compartment
9. rudder
10. 25 cc gas engine
11. soft brush
12. venturi nozzle
13. cleaning brush motor
14. bow thruster
15. propeller
16. 3 inch PVC end cap

DETAILED DESCRIPTION—PREFERRED EMBODIMENT

Figure 2:
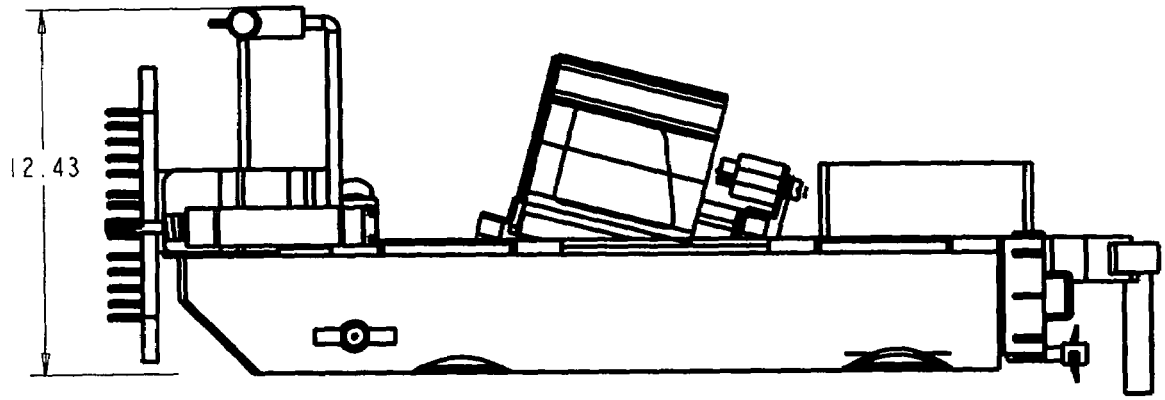
FIG. 2 is a side view of my invention.
Figure 3:
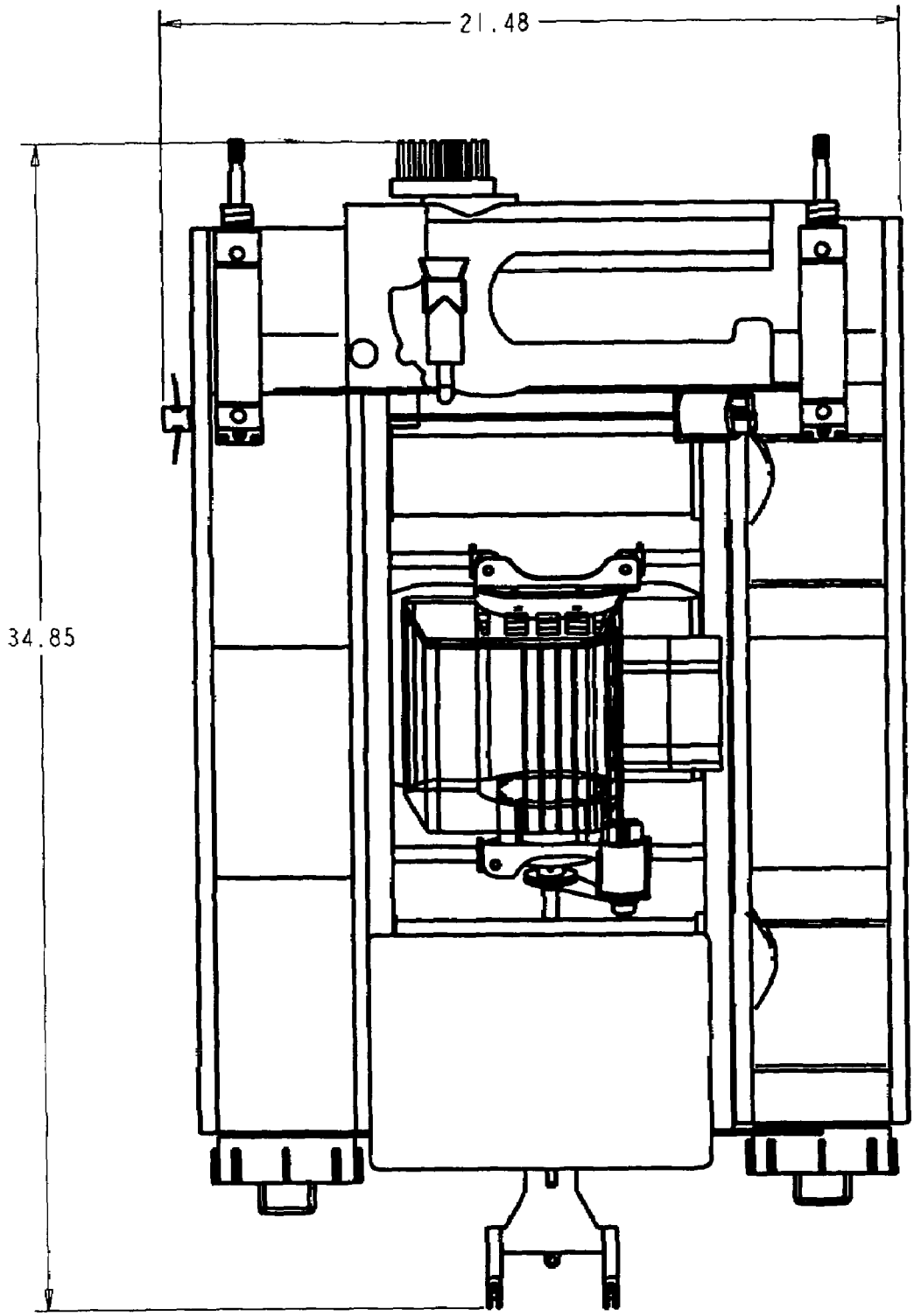
FIG. 3 is a top view of my invention.

A preferred embodiment of the remote waterline cleaner of the present invention is illustrated in FIG. 1 (perspective view), FIG. 2 (side view), and FIG. 3 (top view). The remote waterline cleaner contains a preferred ⅛" thick anodized aluminum main frame 4 which is attached to a pontoon hull 5. The pontoon hull 5 is constructed of preferably three inch diameter Poly-Vinyl-Chloride piping, 2-Part Polyurethane Expanding Foam, 4 oz. Fiberglass cloth, marine grade bondo, and West-Systems Epoxy Paint, which makes for an overall diameter of 4 inches. The pontoon hull 5 is sealed on one end and on the other end has three inch female threads for a three inch PVC end cap 16 to screw to. The pontoon hull 5 is hollow on the inside which acts as ballast tanks.

A 25 cc gas engine 10 is attached to the aluminum main frame 4 and drives a propeller 15. An electronics compartment 8 is attached to the main frame 4. Inside the electronics compartment 8 is a microcontroller, a electronic speed controller, three digital servos, a seven channel receiver, a 4.8V 600 mAh receiver battery, two relays, a mercury switch, and two nine volt batteries. Two anodized aluminum rudders 9 attach to the center aft section of the main frame 4. Attached to the forward main frame 4 is a cleaning brush motor 13 with a soft cleaning brush 11 attached. Attached to the forward main frame is a bow thruster 14. One pressure sensor 6 is attached to the port pontoon hull 5 and one pressure sensor 6 is attached to the starboard pontoon hull 5. A generator 7 is attached to the main frame 4 and is powered by the gas engine 10. A venturi nozzle 12 is attached to the forward main frame 4.

OPERATION

The manner of using the remote waterline cleaner requires the use of a remote control, which is capable of controlling seven channels, which sends signals to the electrical box 8 where the functions of the electrical components are carried out. The remote waterline cleaner propels itself to the yacht by means of a propeller 15 and two rudders 9, which is controlled by the operator at all times.

Once in contact with the yacht, the pressure sensors 6 are activated, the operator now has the option of switching to a fully autonomous operation by the flip of a switch activating the microcontroller, which is capable of operating the remote waterline cleaner around the yacht to successfully clean the waterline, the operator has the capability of interrupting the microcontroller at any time by the flip of a switch on the remote control which triggers two relays and switches over from the microcontroller system to the remote control system, which employs a fail/safe system in the event batteries run down the remote waterline cleaner will reduce throttle position to idle and rudders 9 will go to preferably 50 degrees, which will ensure the remote waterline cleaner never runs away and crashes at high speeds. While the remote waterline cleaner is operated by remote control, I don't wish to be bound by this.

The pontoon hulls 5 serve as flotation devices and ballast tanks for the remote waterline cleaner, since the pontoon hulls are partly above water and partyly below the device is inherently semi-submersible. The nature of the pontoon hull design adds stability by reducing the roll rates generated by an increased polar moment of inertia. End caps 50 can be unscrewed from the hulls 5 and water can fill the ballast chambers. The remote waterline cleaner was designed to be positively buoyant with the ballast chambers completely filled with water, which in a worst case scenario the remote waterline cleaner could fill completely with water and still stay afloat making it almost unsinkable. The additional weight added by the water will allow for different adjustments in the total swept area of the front mounted scrub brush 11.

The scrub brush 11 is mechanically rotated by a cleaning brush motor 13. The scrub brush 11 contacts the dirty waterline and removes the grime with a circular and sideways motion. The direction of rotation is chosen in a way where it assists the bow thruster 14 in moving the cleaner along the yacht. The bow thruster 14 is used as a side thruster to push the remote waterline cleaner in a sideways manner. The venturi nozzle 12 applies water and a biodegradable cleaning agent, which lubes the area to be cleaned for less friction between the brush and boat, which helps to break down oil and other substances not normally broken down with plain water, which helps to rinse the area being scrubbed, which has a infinite supply of water pumped directly from the sea, which utilizes a Bernoulli principle.

The Bernoulli principle based on the geometric configuration of the nozzle works like this . . . a fluid passes thru the nozzle with a certain velocity, on the bottom side of this nozzle a tube is attached to a cleaning agent tank, as the velocity of the fluid increases the pressure decreases in the nozzle creating a suction effect, this causes the cleaning agent to be sucked out and applied into the mainstream of fluid, hence, a more efficient system is created where only one pump is needed to pump water and apply soap.

A cleaning force of approximately 20 lbs is needed to effectively clean the waterline. This 20 lbf was measured empirically. The propeller selection was based on the cleaning force needed, which drove the calculations for determining the horsepower needed, which the gas engine 10 was selected from.

DESCRIPTION—ALTERNATIVE EMBODIMENT—FIGS

Not Applicable

OPERATION—ALTERNATIVE EMBODIMENT—FIGS

Not Applicable

CONCLUSION, RAMIFICATIONS, AND SCOPE

Accordingly, the reader will see that the remote waterline cleaner of this invention can reduce the amount of time and manpower needed to effectively clean dirty waterlines on yachts. Physical exhaustion can be relieved by the use of the remote waterline cleaner which does the work for you, instead of you cleaning the waterline with force, this invention will do it for you by the push of buttons. Furthermore, the remote waterline cleaner has the additional advantages in that it is manufactured from corrosion resistant materials, similar to the materials used in boat building;

it is compact in design allowing for increased maneuverability;

it is remote controlled and has capability to be self automated;

it applies soap and water to the areas targeted for cleaning;

it only needs one person to operate;

it can supply the same amount of cleaning force that a human can supply;

it is gas powered making it available for use all day long;

While my above description contains many specificities, these should not be construed as limitations on the scope of the invention, but rather as an exemplification of one preferred embodiment thereof. Many other ramifications and variations are possible within the teachings of the invention. For example, the remote waterline cleaner can have other shapes for hull selection, such as flat bottom, v-bottom, trihulls, etc.; the hulls can be made of different materials, such as carbon fiber, aluminum, etc.; the cleaning brush can have other shapes, can move in different paths deviating from a radial motion; the gas engine can be replaced by a electric motor; the pressure sensors can be replaced by infrared proximity sensors; the rudders can be eliminated by having two electric motors sufficiently spaced apart and steer like an army tank, more or less one engine in forward and one in reverse will create a torque steer, etc.

Accordingly, the scope of the invention should be determined not by the embodiment(s) illustrated, but by the appended claims and their legal equivalents.

I claim:

1. A floating semi-submersible self-powered device small and light enough to be carried by an average man having means of removing unclean substances from waterlines on floating vessels, comprising:

(a) a floating body carriage having propulsion means mounted there under for powering said body carriage to move through a fluid, (b) an engine mounted to an aluminum frame attached to said carriage for producing rotational energy, and (c) means for controllably coupling rotational energy from said engine to a revolving shaft with spiral blades that creates a forward or backwards thrust, whereby said carriage will be propelled along said fluid, and (d) means for directing said thrust left or right, whereby said carriage will turn when signaled from a remote control as it is propelled, and (e) means for having a side propulsion, whereby said carriage can move in a sideways motion in said fluid when signaled from said remote control, enabling said body to circumvent the floating vessel's waterline being cleaned, and (f) wherein said body includes means of applying a cleansing agent and a rinsing fluid to waterlines on a floating vessel's hull, and (g) wherein said cleansing agent is stored in a container attached to said body carriage.

2. The self-powered device of claim 1 wherein said rinsing fluid is infinitely supplied by the body of fluid said body carriage resides in.

3. The self-powered device of claim 1 wherein said device is operated by remote control and/or microcontroller.

* * * * *